US005872479A

United States Patent [19]

Shin

[11] Patent Number: 5,872,479

[45] **Date of Patent: *Feb. 16, 1999**

[54] APPARATUS FOR REGULATING SUBSTRATE VOLTAGE IN SEMICONDUCTOR DEVICE

[75] Inventor: Yoon Cheol Shin, Seoul, Rep. of Korea

[73] Assignee: LG Semicon Co., Ltd., Cheongju, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 582,263

[22] Filed: Jan. 3, 1996

[30] Foreign Application Priority Data

Jun. 28, 1995 [KR] Rep. of Korea ..... 1995/17890

[51] Int. Cl.[6] ..... G05F 1/10

[52] U.S. Cl. ..... 327/537; 327/534; 327/312; 327/313

[58] Field of Search ..... 327/205, 206, 327/215, 222, 312, 313, 317, 534, 535, 537

[56] References Cited

U.S. PATENT DOCUMENTS

| | | | |
|---|---|---|---|
| 4,210,829 | 7/1980 | Wong et al. | 327/143 |
| 4,229,667 | 10/1980 | Heimbingner et al. . | |
| 4,356,412 | 10/1982 | Moench et al. . | |
| 4,673,866 | 6/1987 | Masuda | 323/323 |
| 5,081,380 | 1/1992 | Chen | 327/262 |
| 5,327,072 | 7/1994 | Savignac et al. | 323/313 |
| 5,532,471 | 7/1996 | Khorramabadi et al. | 327/205 |
| 5,563,549 | 10/1996 | Shieh | 327/543 |

FOREIGN PATENT DOCUMENTS

| | | | |
|---|---|---|---|
| 62-136914 | 6/1987 | Japan | 327/206 |
| 63-31210 | 2/1988 | Japan | 327/206 |

*Primary Examiner*—Terry D. Cunningham
*Attorney, Agent, or Firm*—Fleshner & Kim

[57] ABSTRACT

An apparatus for regulating a substrate voltage in a semiconductor device having a substrate voltage regulator for controlling generation of a substrate voltage so as to supply a pre-set substrate voltage to a substrate, including: a stack of a plurality of resistors being connected in series with each other and a plurality of switches being connected in parallel to corresponding resistors other than a resistor connected to a power supply voltage for decreasing an external voltage applied to one end thereof to a predetermined level; a first transistor having a first electrode connected to another end of the stack of the plurality of the resistors, a gate connected to ground and a second electrode connected to the substrate, for being controlled by a substrate voltage of the substrate; and a second transistor having a gate to which the inverse of a signal outputted from a connecting point between the other end of the stack of the plurality of the resistors and the first transistor is applied, and first and second electrodes selectively connected to the resistors other than the first resistor connected to the power supply voltage, for adjusting a resistance value of the stack of the plurality of the resistors accordingly as the first and second electrodes of the first transistor are selectively connected to the resistors other than the first resistor connected to the power supply voltage, by which a substrate voltage is maintained constant regardless of an unstable variation of a power supply voltage applied from an external source so as to prevent a threshold voltage variation and an operation point variation of the device, thereby obtaining an accurate circuit operation.

14 Claims, 2 Drawing Sheets

APPARATUS FOR REGULATING SUBSTRATE VOLTAGE IN SEMICONDUCTOR DEVICE

BACKGROUND OF THE INVENTION

1. Field of the Invention

The present invention relates to an apparatus for generating a substrate voltage in a semiconductor device, and more particularly to an apparatus for controlling a substrate voltage in a semiconductor device capable of obtaining an accurate circuit operation in a manner that a substrate voltage is maintained constant regardless of an unstable variation of a power supply voltage applied from an external source so as to prevent a threshold voltage variation and an operation point variation in a device.

2. Description of the Prior Art

In order to improve the performance of a DRAM, a negative substrate voltage $V_{BB}$ is necessary, for which in some cases in the past, a negative voltage was applied from an external source. However, it requires an additional power supply, resulting in that a power supply unit became complicated.

FIG. 1 is a block diagram showing a conventional substrate voltage circuit for avoiding any necessity of the external power supply, which includes a substrate 103; a substrate voltage detector 100 for outputting a signal to control a substrate voltage applied to the substrate 103; an oscillator 101 for being oscillated in response to the signal inputted from the substrate voltage detector 100; and a substrate voltage generator 102 for generating a substrate voltage in accordance with the output signal of the oscillator 101 and supplying it to the substrate 103.

The substrate voltage applied to the substrate 103 is generated as the oscillator 100 and the substrate voltage generator 102 are sequentially controlled by the substrate voltage detector 100.

FIG. 2 is a circuit diagram of the substrate voltage detector 100 with a relationship to adjacent circuits of FIG. 1, which includes a PMOS transistor 104 having a source to which a power supply voltage Vcc is applied, and with its gate connected to ground; an NMOS transistor 105 having its drain connected to the drain of the PMOS transistor 104 and having its gate connected to ground; a voltage dropping unit 106 being connected to the source of the NMOS transistor 105 for decreasing an output signal level of the source of the NMOS transistor 105 to a predetermined voltage level and applying the output signal to a substrate voltage terminal (not shown); a PMOS transistor 107 having a source to which the power supply voltage Vcc is applied and having its drain connected to the drain of the PMOS transistor 104; an inverter 108 having an output terminal to which a gate of the PMOS transistor 107 is connected, for inverting the signal commonly outputted from the respective drains of the PMOS transistors 104 and 107; the oscillator 101 being oscillated in response to a control signal from the inverter 108; and the substrate voltage generator 102 for generating a substrate voltage upon receipt of the output signal of the oscillator 101 and applying the generated substrate voltage to the substrate.

The voltage dropping unit 106 has an NMOS transistor 109 with the signal outputted from the source of the NMOS transistor 105 being commonly applied to the gate and to the drain thereof and applying the output voltage thereof to the substrate voltage terminal (not shown).

The operation of the conventional regulator as constructed above will now be described.

When the power supply voltage Vcc is applied to the source of the PMOS transistor 104, the PMOS transistor 104 is turned on while the NMOS transistor 105 is turned off, so that a voltage $V_{OUT}$ appears at a node $N_D$ without any drop) of voltage and accordingly the potential at the node $N_D$ becomes a high potential.

When the voltage of high potential at the node $N_D$ is applied to an input terminal of the inverter 108, the inverter 108 inverts it to output a low potential voltage.

When the low potential voltage outputted from the inverter 108 is applied to the oscillator 101, the oscillator 101 is oscillated and the voltage generator 102 is controlled by the output signal of the oscillator 101, to output a negative substrate voltage.

When the negative substrate voltage $V_{BB}$ is applied to the substrate 103 of FIG. 1, a potential difference between the gate and the source of the NMOS transistor 105 is increased over a threshold voltage, so that the NMOS transistor 105 is operated to be turned on.

Accordingly, a current path, namely, a discharge loop, is formed between the substrate and the node $N_D$.

Immediately when the current path is formed, discharging occurs from the node $N_D$ to the substrate, so that the potential at the node $N_D$ is changed from a high potential to a low potential.

Accordingly, the low potential signal at the node $N_D$ is applied to the input terminal of the inverter 108 and the inverted output becomes a high potential.

The high potential signal, that is, the output inverted by the inverter 108, acts as a control signal to stop the operation of the oscillator 101, so that the operation of the substrate voltage generator 102 is stopped and the substrate voltage is not supplied any longer.

However, in the operation of the DRAM, when a voltage difference between the substrate voltage and the gate of the NMOS transistor 105 is reduced below a threshold voltage as the substrate voltage is increased due to several factors, the NMOS transistor 105 is turned off, so that the voltage $V_{OUT}$ at the node $N_D$ is converted to a high potential according to the power supply voltage, and then this high potential voltage is again converted to a low potential voltage by the inverter 108. Thus, the oscillator 101 and the substrate voltage generator 102 are operated again so as to generate an originally stable substrate voltage.

Accordingly, the increased substrate voltage is changed to an originally stable substrate voltage value to thereby stabilize the operation of the semiconductor device.

The PMOS transistor 107 is adapted for use as a hysteresis control loop and prevents a malfunction of the oscillator 101 and the substrate voltage generator 102 in a transient state, at the very moment that a voltage level outputted from the inverter 108 is converted.

The operation of the substrate voltage detector of the semiconductor device will now be described by equations.

When the substrate voltage detector 100 is operated and a substrate voltage at a normal level is generated, the PMOS transistor 104 and the NMOS transistor 105 are operated at their saturation region.

Accordingly, the source-drain current $I_{DSP}$ of the PMOS transistor 104 is expressed by equation (1) below, while the source-drain current $I_{DSN}$ of the NMOS transistor 105 is expressed by equation (2) below where Vss equals about 0 volts.

$$I_{DSP}=K_P(V_{cc}-V_{TP})^2 \quad (1)$$

$$I_{DSN}=K_N(v_{BB}+V_{TN})^2 \quad (2)$$

$V_{TP}$ and $V_{TN}$ are threshold voltages of the PMOS transistor 104 and the NMOS transistor 105, respectively, and $K_P$ and $K_N$ are constants of the PMOS transistor 104 and the NMOS transistor 105, respectively.

From the equations (1) and (2), since the values of $I_{DSP}$ and $I_{DSN}$ are the same to each other, the equation (3) below is obtained for the substrate voltage $V_{BD}$.

$$|V_{BB}| = \sqrt{K_P/K_N}\,(V_{CC} - V_{TP}) + V_{TN}\,. \quad (3)$$

Therefore, the substrate voltage is considered to be proportional to the power supply voltage. In this respect, it should be noted that the substrate voltage is linearly proportional to the power supply voltage as shown in FIG. 4.

An optimal substrate voltage should be maintained at a constant value as shown by the dotted line in FIG. 4, even though the power supply voltage is increased.

However, the regulator having the above construction of the PMOS transistor 104 and the NMOS transistor 105 as described above has a problem in that the substrate voltage is linearly increased as the power supply voltage is increased as shown in equation (3). Thus, the variation of the substrate voltage renders the threshold voltage of each device to be varied and also varies the operational point of a circuit, causing a disadvantage that an accurate circuit operation as desired can not be obtained.

SUMMARY OF THE INVENTION

Therefore, an object of the present invention is to provide an apparatus for generating a substrate voltage in a semiconductor device, and more particularly to provide an apparatus for regulating a substrate voltage in a semiconductor device capable of obtaining an accurate circuit operation in a manner that a substrate voltage is maintained constant regardless of an unstable variation in a power supply voltage applied from an external source, so as to prevent a threshold voltage variation and an operation point variation in the device.

In order to attain the above object, there is provided an apparatus for regulating a substrate voltage in the semiconductor device including: a stack of a plurality of resistors being connected in series with each other and a plurality of switches being connected in parallel to corresponding resistors other than a resistor connected to a power supply voltage for decreasing an external voltage applied to one end thereof to a predetermined level; a first transistor having a first electrode connected to another end of the stack of the plurality of the resistors, a gate connected to ground and a second electrode connected to a substrate of a semiconductor device, for being controlled by a substrate voltage of the substrate; and a second transistor having a gate to which an inverted output signal of a connecting point between the other end of the stack of the plurality of the resistors and the first transistor is applied, and first and second electrodes selectively connected to the resistors other than the first resistor connected to the power supply voltage, for adjusting a resistance value of the stack of the plurality of the resistors accordingly as the first and second electrodes of the first transistor are selectively connected to the resistors other than the first resistor connected to the power supply voltage.

DETAILED DESCRIPTION OF THE INVENTION

The substrate voltage detector according to the present invention will now be described.

Figure 1:
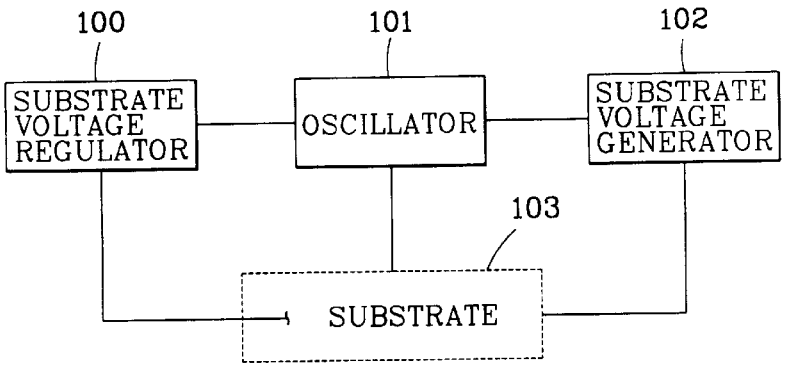
FIG. 1 CONVENTIONAL ART
FIG. 1 is a block diagram of a conventional substrate voltage generator.
Figure 2:
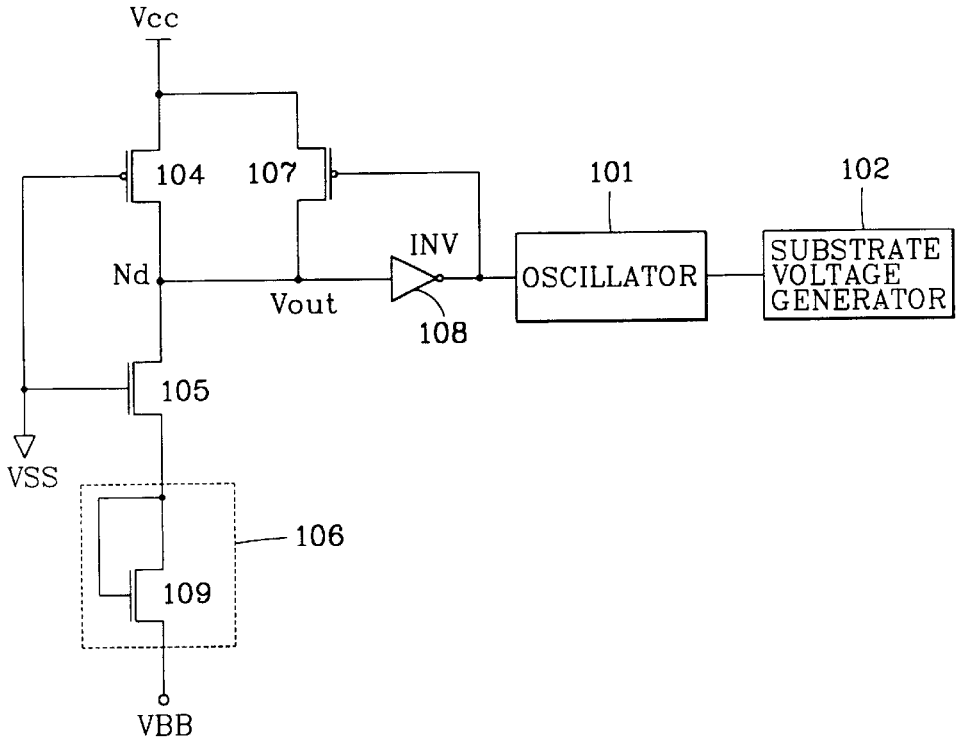
FIG. 2 CONVENTIONAL ART
FIG. 2 is a detailed view of a conventional substrate voltage detector applied to the voltage generator of FIG. 1.
Figure 3:
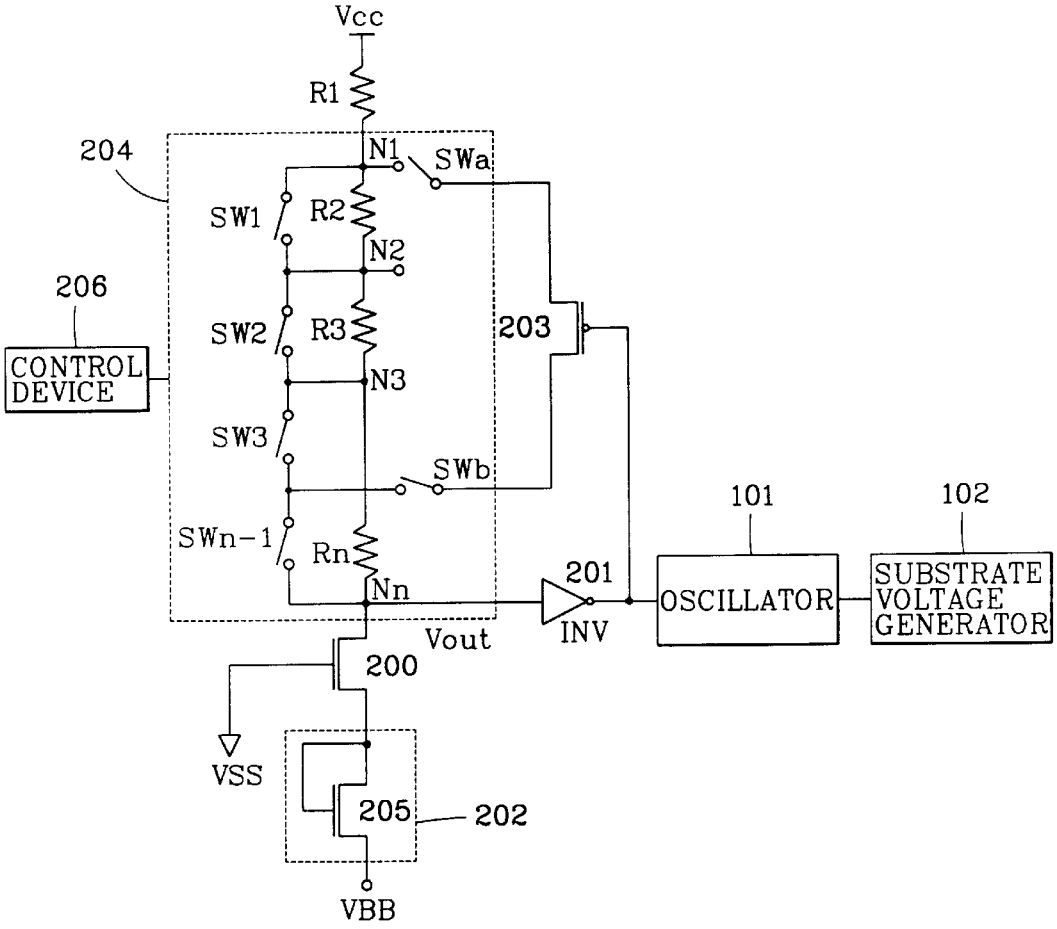
FIG. 3 is a detailed view of a substrate voltage detector in accordance with the present invention.

FIG. 3 is a detailed view of a substrate voltage detector in accordance with the present invention, which includes a resistor R1 for limiting a current upon application of a power supply voltage from one end thereof; a minute resistor adjusting unit 204 being connected to the other end of the resistor R1 for minutely adjusting a resistance value: an inverter 201 for inverting the output signal from the minute resistor adjusting unit 204; a PMOS transistor 203 having its gate connected to the output terminal of the inverter 201 and having its first and second electrodes selectively connected to the resistors other than the resistor R1 connected to the power supply voltage; an NMOS transistor 200 for having a drain to which the output signal of the minute resistor adjusting unit 204 is applied and a gate connected to ground; a voltage dropping unit 202 for receiving and decreasing the output signal of the source of the NMOS transistor 200 to a predetermined level and outputting it to a substrate voltage terminal (not shown); an oscillator 101 for outputting an oscillated signal in response to the output signal of the inverter 201; and a substrate voltage generator 102 for generating a substrate voltage and outputting it to a substrate upon receipt of the output signal of the oscillator 101.

The minute resistor adjusting unit 204 includes, as shown in FIG. 3, a resistor R1, resistors $R_2$–$R_n$ connected in series between resistor R1 and a node $N_n$, and switches $SW_1$–$SW_{n-1}$ connected in parallel with respective resistors $R_2$–$R_n$. The minute resistor adjusting unit can be internally or externally controlled, for example, by a control device 206.

The voltage dropping unit 202 includes an NMOS transistor 205 for having the output signal of the source of the NMOS transistor 200 applied to the drain and the gate thereof and having the source thereof connected to a substrate voltage terminal (not shown).

The operation of the present invention as constructed above will now be described in detail.

When a power supply voltage is applied to the Vcc terminal, an output voltage $V_{OUT}$ of Nth node $N_n$ has the same voltage level because a potential of the source of the NMOS transistor 200 is almost the same as a potential of the gate thereof.

That is, the voltage $V_{OUT}$ becomes a high potential and is applied to the input terminal of the inverter 201. The inverted output signal from the inverter 201 becomes a low potential and acts as a control signal to control the oscillator 101 and the substrate voltage generator 102. Accordingly, the oscillator 101 and the substrate voltage generator 102 are operated to generate a negative substrate voltage, and the generated substrate voltage is supplied to the substrate 103.

At this time, when the substrate voltage is supplied, a voltage difference between the gate and the source of the NMOS transistor is greater than a threshold voltage thereof, so that the NMOS transistor 200 is operated.

That is, the NMOS transistor 200 is turned on and forms a current path from the nth node $N_n$ to the substrate, namely, a discharge loop.

Accordingly, discharging occurs from the Nth node $N_n$ of high potential toward the substrate, so that the Nth node $N_n$ voltage $V_{OUT}$ is converted to a low potential and is again converted to a high potential after passing through the inverter 201, by which the operation of the oscillator 101 and the substrate voltage generator 102 are stopped and generation of the substrate voltage supplied to the substrate 103 is also stopped.

Thereafter, when the substrate voltage $V_{BB}$ is increased due to several factors and a potential difference between the gate and the source of the NMOS transistor 200 becomes smaller than the threshold voltage thereof, the NMOS transistor 200 would not be operated, so that the voltage of the Nth node $N_n$ is converted to a high potential, that is, to the level of the power supply voltage Vcc.

Accordingly, by repeatedly performing the same operation as described above, the substrate voltage generator 102 is operated to decrease the increased substrate voltage to a pre-set stable voltage.

Connecting relations and operation of the PMOS transistor 203 and the minute resistor adjusting unit 204 are as follows.

In case that when the source and the drain of the PMOS transistor 203 are respectively connected to the first node $N_1$ and the second node $N_2$ through switches SWa and SWb, the switch $SW_1$ connected in parallel with resistor R2 is opened while the other switches $SW_{,}$, $SW_3$, . . . , $SW_{n-1}$ are closed.

On the other hand, when the switches $SW_a$ and $SW_b$ are respectively connected to the first and third nodes $N_1$ and $N_3$, the switches $SW_1$ and $SW_2$ respectively connected in parallel with the resistors $R_2$ and $R_3$ are opened while the other switches $SW_3$, $SW_4$, . . . , $SW_{n-1}$ are closed, so as to minutely adjust the resistance value. Thus, the semiconductor device designer can adjust a hysteresis voltage level in designing the semiconductor device for preventing any malfunction at a transient state between the operation and the stoppage of the oscillator 101 and the substrate voltage generator 102.

The above operation can be expressed by the equations below.

Referring to FIG. 3, at a normal condition, when the substrate voltage detector is operated, the current $I_R$ flowing through the resistors $R_1$, $R_2$, . . . $R_N$ is obtained as below (provided that $R=R_1+R_2+\ldots R_N$)

$$I_R=(V_{CC}-V_{OUT})/R \tag{4}$$

And, at this time, the NMOS transistor 200 is operated at a saturation region thereof, and the current $I_{DSN}$ flowing between the drain and the source is the same as in the above equation (2).

Accordingly, the equations (2) and (4) have the same values with each other, so that the following equation (5) can be obtained for the substrate voltage:

$$|V_{BB}| = \{\sqrt{(V_{CC} - V_{OUT})R/K_N}\} + V_{TN} \tag{5}$$

Therefore, it is noted that the substrate voltage $V_{BB}$ is proportional to the value $\sqrt{Vcc}$.

Figure 4:
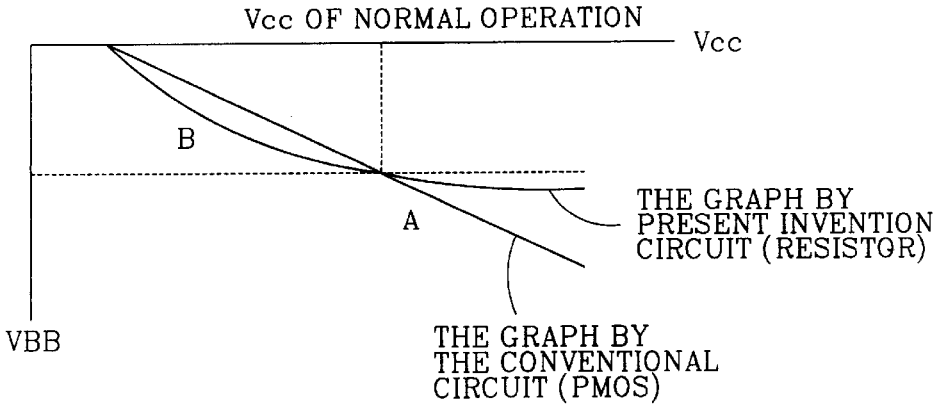
FIG. 4 is a graph showing the relationship between an external power supply voltage Vcc and a substrate voltage $V_{BB}$.

The graph of FIG. 4 shows the relationship between the power supply voltage Vcc and the substrate voltage $V_{BB}$ according to the present invention, from which it is noted that even though the power supply voltage is increased and reaches a constant substrate voltage value, no variation occurs in the substrate voltage.

Also, at an initial stage, that is, when the power supply voltage begins to increase, as shown by the plot B according to the present invention, the power supply voltage is more quickly decreased in comparison with that of the plot A of the conventional art. This is advantageous when the initial power supply is set up in the semiconductor chip.

As so far described, according to the present apparatus for regulating the substrate voltage in the semiconductor device, the substrate voltage is maintained constant regardless of an unstable variation of the power supply voltage applied from an external source so as to prevent a threshold voltage variation and an operation point variation in the device, thereby obtaining an accurate circuit operation.

What is claimed is:

1. A circuit for controlling a bias voltage generator providing a prescribed bias voltage to a semiconductor device comprising:

a first resistor having first and second electrodes, the first electrode being coupled for receiving a prescribed first voltage;

a variable resistive unit coupled to the second electrode of the first resistor;

a first transistor having first and second electrodes and a control electrode, said first and second electrodes being directly coupled to the variable resistive unit;

a second transistor having first and second electrodes and a control electrode, the control electrode coupled for receiving a second prescribed voltage, the first electrode being coupled for receiving the output of said variable resistive unit, and the second electrode being coupled to the semiconductor device for receiving a bias voltage of the semiconductor device; and an inverter having an input electrode coupled to the second electrode of the variable resistive unit and an output electrode coupled to the control electrode of the first transistor, wherein a resistance of said variable resistive unit coupled between the first and second electrodes of said first transistor controls a hysteresis voltage level of the input electrode of the inverter.

2. The circuit of claim 1, further comprising a third transistor having first and second electrodes and a control electrode, the first and control electrodes of the third transistor are coupled to the second electrode of the second transistor, and the second electrode of the third transistor being coupled for receiving the prescribed bias voltage.

3. The circuit of claim 1, wherein said variable resistive unit comprises:

a plurality of resistors coupled in series;

a plurality of first switches coupled in series, each corresponding first switch being coupled to each corresponding resistor in parallel;

a second switch coupled to the first electrode of said first transistor; and a third switch coupled to the second electrode of said first transistor, wherein said plurality of first switches are opened or closed, and said second and third switches are further coupled to corresponding nodes between said plurality of resistors coupled in series to vary the resistance between the first and second electrodes of said first transistor.

4. The circuit of claim 2, where said prescribed first and second voltages are source and ground voltages, respectively, said first transistor is a PMOS transistor, and said second and third transistors are NMOS transistors.

5. The circuit of claim 1, wherein the bias voltage is substantially constant regardless of variations in the prescribed first voltage over a threshold voltage.

6. The circuit of claim 1, wherein the output electrode of the invertor is coupled to the bias voltage generator to provide a control signal.

7. An apparatus for providing a prescribed bias voltage to a substrate of a semiconductor device, comprising:

a. a substrate bias voltage generator that selectively applies the prescribed bias voltage to the substrate;

b. an oscillator coupled to said substrate bias voltage generator; and c. a substrate voltage detector coupled to said oscillator and the substrate to detect an application of the prescribed voltage, said substrate voltage detector includes:

(i) a first resistor having first and second electrodes, the first electrode being coupled for receiving a prescribed first voltage;

(ii) a variable resistive unit coupled to the second electrode of said first resistor and having an output electrode;

(iii) a first transistor having first and second electrodes and a control electrode, said first and second electrodes being coupled to said variable resistive unit and the control electrode being coupled for receiving an output of said variable resistive unit; and (iv) a second transistor having first and second electrodes and a control electrode, the control electrode coupled for receiving a second prescribed voltage, the first electrode being coupled for receiving the output of said variable resistive element, and the second electrode being coupled to the semiconductor device for receiving a signal indicative of an instantaneous voltage level voltage of the substrate, wherein said variable resistive unit comprises, a plurality of resistors coupled in series, a plurality of first switches coupled in series, each corresponding first switch being coupled to each corresponding resistor in parallel, a second switch coupled to the first electrode of said first transistor, and a third switch coupled to the second electrode of said first transistor, wherein said plurality of first switches is opened or closed, and said second and third switches are further coupled to corresponding nodes between said plurality of resistors coupled in series to vary the resistance between the first and second electrodes of said first transistor.

8. The apparatus of claim 7, wherein a resistance of said variable resistive unit between the first and second electrodes of said second transistor is varied to control a hysteresis voltage level of said second transistor.

9. The circuit of claim 7, wherein said substrate voltage detector further comprises a third transistor having first and second electrodes and a control electrode, the first and control electrodes of the third transistor being coupled to the second electrode of said second transistor, and the second electrode of the third transistor coupled for receiving the prescribed bias voltage applied to the substrate by said substrate bias voltage generator.

10. The circuit of claim 9, wherein said prescribed first and second voltages are source and ground voltages, respectively, said first transistor is a PMOS transistor, and said second and third transistors are NMOS transistors.

11. A circuit for controlling a bias voltage generator providing a prescribed bias voltage to a semiconductor device, comprising:

a first resistive element having first and second electrodes, the first electrode being coupled for receiving a prescribed first voltage;

a variable resistive unit coupled to the second electrode of the first resistor;

a first transistor having first and second electrodes, said first and second electrodes being coupled to the variable resistive unit;

a control unit that controls a resistance of the variable resistive unit;

a second transistor having first and second electrodes and a control electrode, the control electrode and the first electrode coupled for receiving an output of said variable resistive unit, and the second electrode being coupled to the semiconductor device for receiving a a voltage level of the semiconductor device based on the prescribed bias voltage generated by the bias voltage generator, wherein a voltage level of said output of said variable resistive unit is based on the resistance of said variable resistive unit, wherein the control electrode of the first transistor is coupled to the output of the variable resistive unit, and wherein said variable resistive unit comprises, a plurality of resistors coupled in series, and a plurality of first switches coupled in series, each corresponding first switch being coupled to each corresponding resistor in parallel, wherein said plurality of first switches are opened or closed by the control unit to vary the resistance of the variable resistance unit so that the prescribed bias voltage is independent of the prescribed first voltage when the prescribed first voltage is greater than a threshold value;

a second switch coupled to the first electrode of said first transistor; and a third switch coupled to the second electrode of said first transistor wherein said second and third switches are further coupled to corresponding nodes between said plurality of resistors coupled in series to vary the resistance of the variable resistive unit.

12. The circuit of claim 11, further comprising:

a third transistor having first and second electrodes and a control electrode, the first and second electrodes being coupled to the first electrode of said second transistor and the variable resistive unit, respectively, and the control electrode of the third transistor being coupled for receiving a second prescribed voltage; and an inverter having an input electrode coupled to the output of said variable resistive unit, and an output electrode coupled to the control electrode of said second transistor.

13. An apparatus for providing a prescribed bias voltage to a substrate of a semiconductor device comprising:

(a) a substrate bias voltage generator that selectively applies the prescribed bias voltage to the substrate;

(b) an oscillator coupled to said substrate bias voltage generator; and (c) a substrate voltage detector coupled to said oscillator and the substrate to detect an application of the prescribed voltage, said substrate voltage detector includes:

(i) a first resistive element having first and second electrodes, the first electrode being coupled for receiving a prescribed first voltage;

(ii) a variable resistive unit coupled to the second electrode of said first resistive element and having an output electrode;

(iii) a first transistor having first and second electrodes and a control electrode, said first and second electrodes being directly coupled to said variable resistive unit and the control electrode being coupled to the output electrode of said variable resistive unit;

(iv) a second transistor having first and second electrodes and a control electrode, the control electrode coupled for receiving a second prescribed voltage, the first electrode being coupled for receiving the output of said variable resistive element, and the second electrode being coupled to the semiconductor device for receiving a current bias voltage of the substrate; and (v) an inverter having an input electrode coupled to the second electrode of the variable resistive unit and an output electrode coupled to the control electrode of the first transistor, wherein a resistance of said variable resistive unit coupled between the first and second electrodes of said first transistor controls a hysteresis voltage level of the input electrode of the inverter.

14. The apparatus of claim 13, wherein a resistance of said variable resistive unit between the first and second electrodes of said transistor controls a hysteresis voltage level of said first transistor, and wherein said variable resistive unit comprises:

a plurality of resistors coupled in series;

a plurality of first switches coupled in series, each corresponding first switch being coupled to each corresponding resistor in parallel;

a second switch coupled to the first electrode of said first transistor; and a third switch coupled to the second electrode of said first transistor, wherein said plurality of first switches are opened or closed, and said second and third switches are further coupled to corresponding nodes between said plurality of resistors coupled in series to vary the resistance between the first and second electrodes of said first transistor.

* * * * *